US005926895A

United States Patent [19]

Roy

[11] Patent Number: 5,926,895

[45] **Date of Patent: *Jul. 27, 1999**

[54] VACUUM CLEANER HOSE CLEANING BRUSH

[76] Inventor: Richard Roy, 12950 S.E. 104th Ct., Belleview, Fla. 34420

[ * ] Notice: This patent issued on a continued prosecution application filed under 37 CFR 1.53(d), and is subject to the twenty year patent term provisions of 35 U.S.C. 154(a)(2).

[21] Appl. No.: 08/693,711

[22] Filed: Aug. 7, 1996

[51] Int. Cl.[6] ..... A46B 5/02; B08B 9/02

[52] U.S. Cl. ..... 15/104.2; 15/143.1; 15/144.4; 15/164; 15/206

[58] Field of Search ..... 15/23, 104.05, 15/104.16, 104.2, 143.1, 160, 144.1, 144.4, 164, 206, 340.1

[56] References Cited

U.S. PATENT DOCUMENTS

| | | | |
|---|---|---|---|
| 2,172,195 | 9/1939 | Elson | 15/23 |
| 2,929,087 | 3/1960 | Salmon | 15/144.1 |
| 2,951,632 | 9/1960 | Hanson | 15/340.1 |
| 4,792,363 | 12/1988 | Franklin, Jr. | 15/104.2 |
| 4,819,291 | 4/1989 | Gunjian | 15/104.2 |
| 5,033,155 | 7/1991 | Klotz | 15/164 |
| 5,168,593 | 12/1992 | Poje | 15/104.2 |
| 5,253,386 | 10/1993 | LaLonde | 15/104.2 |
| 5,297,310 | 3/1994 | Cox | 15/104.2 |
| 5,560,069 | 10/1996 | Berger | 15/143.1 |

FOREIGN PATENT DOCUMENTS

| | | | |
|---|---|---|---|
| 449467 | 9/1927 | Germany | 15/104.2 |
| 592481 | 2/1934 | Germany | 15/104.2 |
| 6521 | 3/1906 | United Kingdom | 15/104.2 |
| 12360 | 5/1913 | United Kingdom | 15/104.2 |
| 872987 | 7/1961 | United Kingdom | 15/143.1 |

*Primary Examiner*—Randall E. Chin
*Attorney, Agent, or Firm*—Saliwanchik, Lloyd & Saliwanchik

[57] ABSTRACT

The subject invention pertains to a tool that may be used for cleaning hoses from vacuum cleaner machines. The tool comprises a brush or similar cleaning device attached to an end of a length a semi-rigid tube. In use, the cleaning tool is inserted into a vacuum cleaner hose after detachment of the hose from the vacuum cleaner; the inside surface of the hose is then cleaned of dust and other entrapped particles.

4 Claims, 2 Drawing Sheets

VACUUM CLEANER HOSE CLEANING BRUSH

BACKGROUND OF THE INVENTION

Vacuum cleaners are widely used in industrial, commercial, residential, and other indoor environments to remove dust, dirt, debris, and other particles from floors and floor coverings, window treatments, furniture, sculptures and other decorative items, plants, and other articles. In some instances, vacuum cleaners are also used in outdoor applications.

Most vacuum cleaners are machines that operate by creating an air suction force that is strong enough to lift dust, dirt, and other small particles from the articles to be cleaned. The particles are usually directed into the vacuum cleaner through a cleaning head that increases the cleaning contact area. Additionally, some machines have brushes that help sweep the particles into the vacuum cleaner. After being drawn through the cleaning head, the particles are directed into a collection bag or similar receptacle. The collection bag is periodically emptied or replaced.

There are many different versions of vacuum cleaners. Common vacuum cleaner designs include hand-held, upright, and canister models. Hand-held and upright models often incorporate all the elements of the cleaner into a single unit. In contrast, canister models usually house a motor and collection bag in a rolling unit attached by a flexible hose to a cleaning head. Many upright models, in addition to having a floor-level cleaning head, also have a flexible hose that can be fitted with supplementary cleaning tools, thereby expanding the cleaning capabilities of the vacuum cleaner. Also, hand-held models frequently have a short tube through which dirt and dust are directed into a collection bag.

The tube or flexible hose attached to many vacuum cleaners comes in a variety of lengths and configurations. For example, it may be rigid and fairly short, as in a hand-held vacuum. Or it may be flexible and relatively long, allowing the user to position the head into corners, behind furniture, along ceilings, and other difficult-to-reach locations.

For optimal cleaning performance and vacuum cleaner longevity, the air suction supplied by the vacuum cleaner motor must not be blocked at any point along the path from the motor to the cleaning head of the vacuum cleaner, which contacts the surface to be cleaned. While vacuum cleaner users generally realize the importance of emptying or replacing the vacuum cleaners' dust collection bags regularly to maintain peak performance, many do not realize that another region of potential air flow blockage is often overlooked: the vacuum cleaner hose. Removing accumulated particulate matter from the inside surface of the hose allows the vacuum cleaner to sustain its suction force without placing additional stress on the motor. Thus, hose cleaning serves to maintain a vacuum cleaner's efficiency and prolong its life by reducing demands on its motor.

In addition to the failure of most people to recognize the importance of a clean vacuum cleaner hose, the vacuum cleaner hose is very difficult to effectively clean even if one desired to do so. The subject invention provides a simple tool for effective vacuum cleaner hose cleaning.

BRIEF SUMMARY OF THE INVENTION

The subject invention pertains to tools and methods useful for easily and efficiently cleaning vacuum cleaner hoses. The tools of the subject invention comprise a brush or other cleaning head attached to a length of semi-rigid elongate tube material. The elongate tube to which the cleaning device is attached must be sufficiently rigid to facilitate clearing away of dust and particles from the inside walls of the hose. The tube should also be sufficiently flexible to pass through a hose having one or more bends or curves. The bristles or other cleaning surface of the cleaning head should be sufficiently rigid to facilitate removal of dust and other debris impacted upon the inner surface of the vacuum cleaner hose.

The tool of the subject invention may be inserted into a vacuum cleaner hose, preferably after detachment of such hose from the vacuum cleaner. The inside surface of the hose can then be brushed free of dust and other entrapped particles by simple manipulation of the cleaning device. When the cleaning is completed, the cleaning tool of the subject invention can be easily cleaned if necessary and stored in a convenient location.

Use of the cleaning tool of the subject invention prolongs the life of the vacuum cleaner motor and results in much more efficient cleaning, which saves time and can increase carpet longevity due to increased removal of dirt and sand.

DETAILED DISCLOSURE OF THE INVENTION

Figure 1:
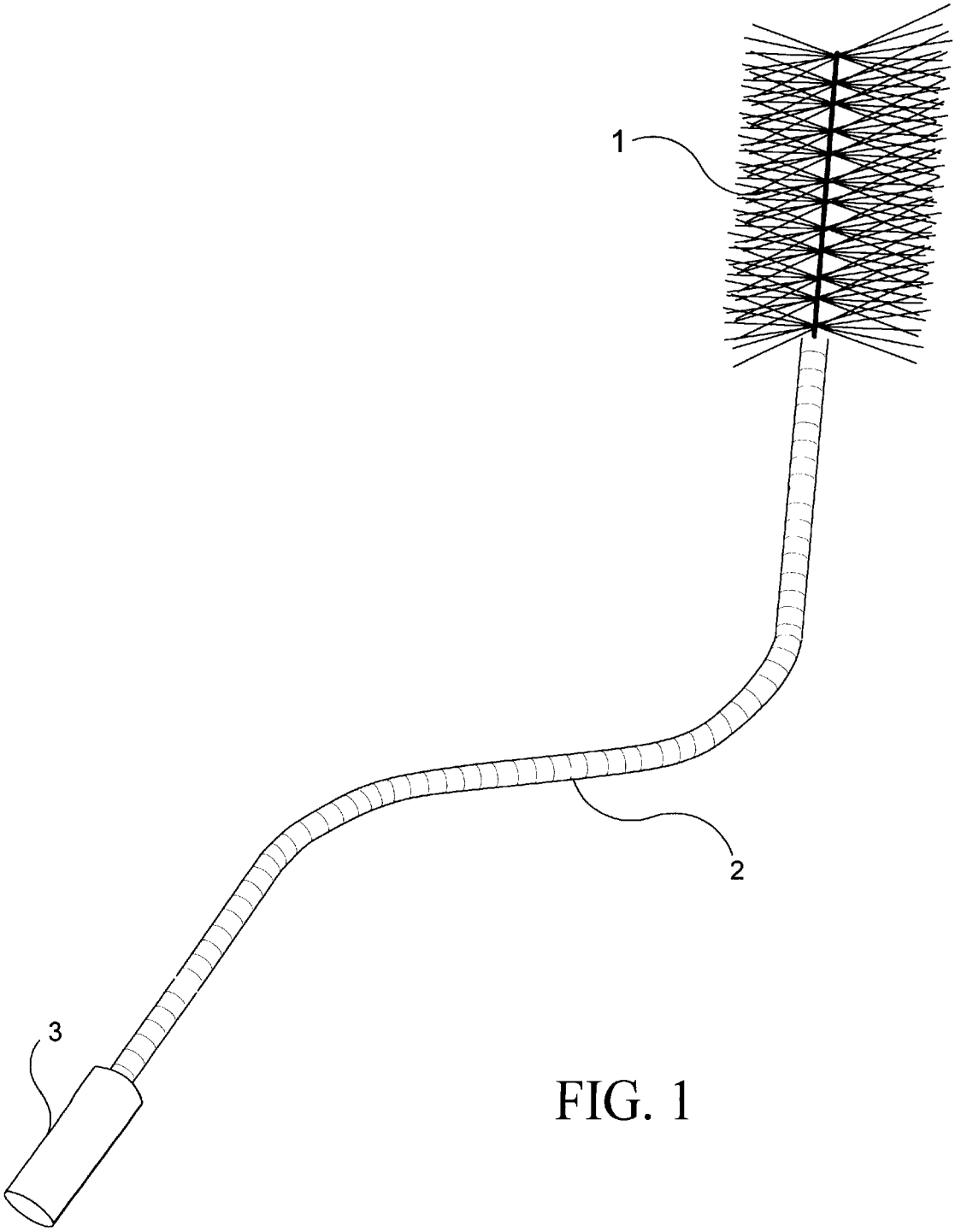
FIG. 1 is an illustration of a specific embodiment of the subject invention.
Figure 2A:
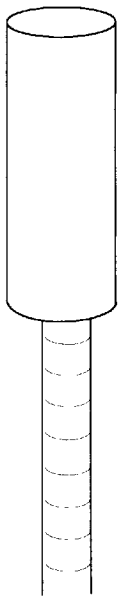
FIG. 2 describes alternative types of handles.
Figure 2B:
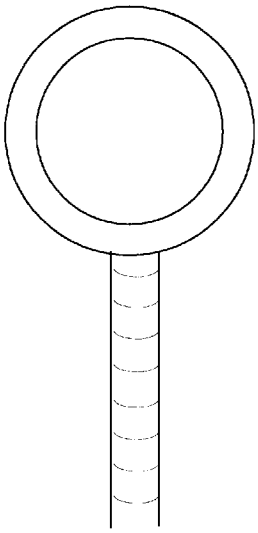
Figure 2C:
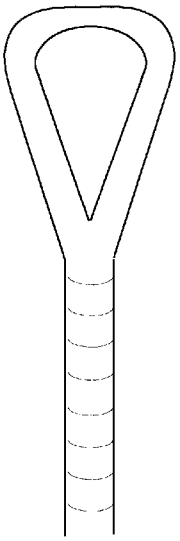
Figure 2D:
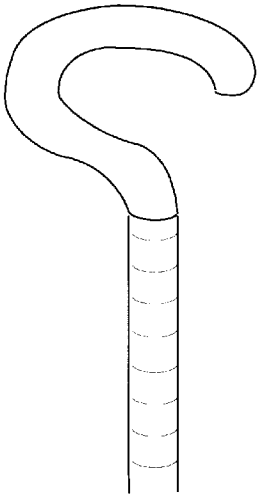
Figure 2E:
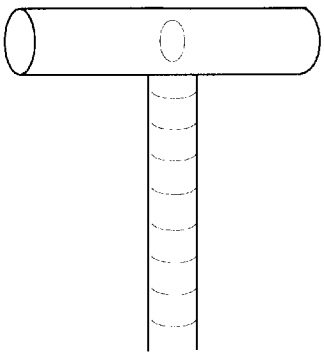
Figure 2F:
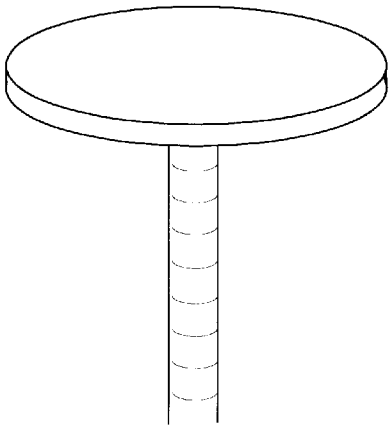

The subject invention pertains to tools for cleaning the inside surface of vacuum cleaner hoses of dust, debris, and other particles. FIG. 1 illustrates one specific embodiment of the subject invention.

In a preferred embodiment, the tool of the subject invention comprises a cleaning head 1 that is attached to a sturdy, yet flexible (semi-rigid) elongate tube. The cleaning head typically will comprise stiff bristles having sufficient rigidity to remove caked-on dust, dirt, and grime from the inside of a vacuum cleaner hose. The brush may have, for example, stiff plastic bristles. Other appropriate materials, including, for example, rubber and metal, may be used to make the cleaning head. The cleaning head may be, for example, a cylindrical brush of about 2 inches in diameter and about 4 inches long. Alternatively, the cleaning head may be spherical or any other shape or size that will fit into a vacuum cleaner hose. In another embodiment, the cleaning head may be made to rotate about the longitudinal axis of the hose, powered by a battery or other energy source.

The cleaning head of the tool of the subject invention is attached to a semi-rigid elongate longitudinal body (tube) 2. The body can be, for example, a semi-rigid length of hollow or solid tube which may have a circular or other-shaped cross section. The elongate body may be, for example, about 6 feet long, but may be made to any length to accommodate vacuum cleaner hoses of different lengths. The elongate body portion may be expandable so that, when not in use, the tool can be stored in a small space. If the elongate tube telescopes, it is necessary to have a locking mechanism to hold the tube in place when it is in use in its expanded form.

The elongate body portion of the tool of the subject invention may be about 1 inch in cross-sectional diameter, but may be larger or smaller, depending on the application. More rigid materials and larger cross-sectional areas allow the user to more easily apply pushing forces in order to direct the cleaning tool into a vacuum hose; more flexible materials and smaller cross-sectional areas allow the user to bend the tool into a compact configuration for storage ease.

As used herein, reference to a "semi-rigid" tube or elongate body refers to a tube with sufficient rigidity to push a cleaning head through a dirty vacuum cleaner hose without excessive bending of the tube. Excessive bending is defined herein as bending which prevents or impedes the tube from further movement through the hose. The semi-rigid tube of the elongate body portion must also resist rotational torque so that the brush (or other cleaning head device) can be effectively rotated by rotating the opposite end of the elongate tube. If the tube is capable of rotational twisting, it will become difficult to rotate the cleaning head by simply rotating the opposite end of the elongate body portion. Thus, an important aspect of the subject invention is the provision of a brush (or other cleaning device) attached to a semi-rigid tube (or other elongate body) wherein the brush is sufficiently stiff to effectively clean impacted dirt from the inside of a vacuum cleaner hose, and the tube is sufficiently rigid to facilitate pushing the brush through the hose and twisting the brush within the hose, even when substantial dirt and debris are present.

Suitable materials from which the body portion can be constructed include, but are not limited to, plastic, wood, rubber, and metals. A particularly preferred embodiment utilizes ½-inch diameter hollow conduit tube as the body portion. Another preferred embodiment is semi-rigid rubber hose such as automotive hoses. Semi-rigid woven cables can also be used. Preferably, the semi-rigid elongate body portion is non-conductive. The body may be manufactured in any combination of materials, lengths, and cross-sectional areas to impart the desired performance and physical characteristics, including weight, size, color, strength, and durability. Preferably, the elongate tube will be greater than ⅛" in diameter.

The cleaning head 1 may be attached to the body 2 by adhesives, nails, staples, a combination thereof, or any other means of attachment known in the art. The cleaning head may be attached temporarily to the body using a snap-in, screw-on, or similar feature to facilitate easy removal of the cleaning head for replacement or cleaning.

The tool of the subject invention may optionally comprise a handle portion 3. The handle may be, for example, a simple cylinder. Alternatively, as shown in FIG. 2, the handle can be of any shape, preferably one that facilitates its storage on hooks or brackets, which are often found in tool storage areas. The handle may be made of any of a number of materials, including wood, plastic, rubber, and metal. A solid handle may also be covered with a spongy rubber or other material for comfort.

The handle 3 may be attached to the body 2 by adhesives, nails, staples, a combination thereof, or any other means of attachment known in the art.

Following are examples which illustrate procedures for practicing the invention. These examples should not be construed as limiting.

EXAMPLE 1

In one embodiment, a user employs the tool of the subject invention by first removing the hose from a vacuum cleaner. Although cleaning is most effective on a fully detached hose, if a hose is difficult to disengage complete, it may be cleaned through just one open end. For best results, cleaning should be done periodically on a regular basis. The tool of the subject invention can also be used to remove acute hose blockages which can result from, for example, vacuuming in an object which is too large to pass easily through the hose.

Referring to FIG. 1, the user inserts the cleaning head 1 of the invention through an open end of the hose and feeds it through the length of the hose by pushing on the body 2 and/or the handle 3. The user can then clean the inside surface of the hose by pushing, pulling, and rotating the invention within the hose to dislodge dust, debris, and other particles. These motions should be continued along the length of the hose until the entire interior surface has been cleaned. After the cleaning tool is removed from the cleaned hose, the hose should be reattached to the vacuum machine; the machine should then be turned on so that residual particles are carried from the inside of the hose to the collection bag of the machine. The cleaning tool can then easily be shaken and/or rinsed off and then stored.

It should be understood that the example and embodiments described herein are for illustrative purposes only and that various modifications or changes in light thereof will be suggested to persons skilled in the art and are to be included within the spirit and purview of this application and the scope of the appended claims.

I claim:

1. A tool for cleaning the interior of a vacuum cleaner hose wherein said tool comprises a brush wherein said brush is about 2 inches in diameter and wherein said brush is attached to an elongate body wherein said elongate body has a diameter of at least about ½ inch and is approximately 6 feet in length and has sufficient rigidity to facilitate pushing and twisting of said brush within said vacuum cleaner hose to remove dirt and debris without damaging the hose, and wherein said brush has sufficient rigidity to remove dirt and debris without damaging the hose.

2. The tool, according to claim 1, wherein said brush is detachably attached to said elongate body.

3. The tool, according to claim 1, which further comprises a handle attached to said body at an end opposite said brush.

4. The tool, according to claim 1, wherein said elongate body is comprised of a hollow conduit tube.

* * * * *